US005225743A

United States Patent [19]

Codina et al.

[11] Patent Number: 5,225,743

[45] Date of Patent: Jul. 6, 1993

[54] HIGH VOLTAGE SWITCH

[75] Inventors: George G. Codina, Van Nuys, Calif.; Thomas J. Richards, Peoria; Everett G. Brandt, Chillicothe, both of Ill.

[73] Assignee: Caterpillar Inc., Peoria, Ill.

[21] Appl. No.: 791,709

[22] Filed: Nov. 14, 1991

[51] Int. Cl.[5] ..... H01J 11/04; H01J 17/48

[52] U.S. Cl. ..... 315/349; 313/589; 313/622

[58] Field of Search ..... 315/349, 111.2, 40; 313/147, 589, 622

[56] References Cited

U.S. PATENT DOCUMENTS

| | | | |
|---|---|---|---|
| 2,512,538 | 6/1950 | Baker | 315/349 |
| 3,510,716 | 5/1970 | Carter | 313/147 |
| 4,267,484 | 5/1981 | O'Loughlin | 313/325 |
| 4,442,383 | 4/1984 | Hill | 315/349 |
| 4,563,608 | 1/1986 | Lawson et al. | 313/231.71 |
| 4,912,369 | 3/1990 | Moran et al. | 315/58 |
| 4,970,433 | 11/1990 | Thayer, III | 315/111.01 |
| 4,990,831 | 2/1991 | Thayer, III | 315/111.01 |

*Primary Examiner*—Robert J. Pascal
*Assistant Examiner*—R. A. Ratliff
*Attorney, Agent, or Firm*—James R. Yee

[57] ABSTRACT

A switch includes a housing forming a cavity, a first electrode, and a second electrode. The first electrode has an inner surface having a generally circular cross-section perpendicular to an axis and extending along the cavity in a first direction along the axis, forming a hollow tube. The second electrode has a generally circular cross-section perpendicular to the axis and extending into the cavity in a second direction along the axis. The second electrode extends at least partially into the hollow tube formed by the first electrode.

24 Claims, 5 Drawing Sheets

HIGH VOLTAGE SWITCH

DESCRIPTION

1. Technical Field

This invention relates generally to high voltage switches and more particularly to a spark gap switch triggered by a change in pressure.

2. Background Art

Spark gap switches have many uses in high power applications with short switching time intervals or short pulse durations. The basic spark gap switch includes a housing and a pair of electrodes. When a high voltage is applied to the electrodes, an arc is created between the electrodes and current is allowed to pass through the switch.

Typically, the main electrodes of a spark gap switch are basically pins or rods with the ends pointing at each other. Therefore, when an arc forms between the electrodes all the current passes in the area between the ends of the electrodes. This creates a high current density and furthermore a high inductance switch.

However, some applications require faster switches with shorter on/off time intervals and have higher power requirements than is typical of conventional switches. Furthermore, reliability and a longer useful life are desirable. Safety, that is, the prevention of random firings of the switch, is another key issue.

The key factors in achieving these requirements are lowering the inductance of the switch and decreasing the electrical losses. The cleanliness of the switch's inner surface also influences safety, reliability and the useful life of the switch.

The subject invention is directed at overcoming one or more of the problems as set forth above.

DISCLOSURE OF THE INVENTION

In one aspect of the present invention a switch is provided. The switch includes a housing, which forms a cavity, and first and second electrodes. The first electrode has an inner surface. The inner surface has a generally circular cross-section perpendicular to an axis and extends along the cavity in a first direction along the axis, forming a hollow tube. The second electrode has a generally circular cross-section perpendicular to the axis and extends into the cavity in a second direction along the axis. The second electrode extends at least partially into the hollow tube formed by the first electrode.

In another aspect of the present invention, an apparatus, including a switching element, is provided. The switching element includes a housing and first and second electrodes and forms a pressurized cavity filled with gas. The first and second electrodes have a predetermined spatial relationship with respect to each other within said pressurized cavity. The pressure within said cavity is controllably increased and decreased between an open pressure value and a closed pressure value. The gas acts as an insulator between the first and second electrodes under said open pressure value and as a short circuit under said closed pressure value.

BEST MODE FOR CARRYING OUT THE INVENTION

Figure 1:
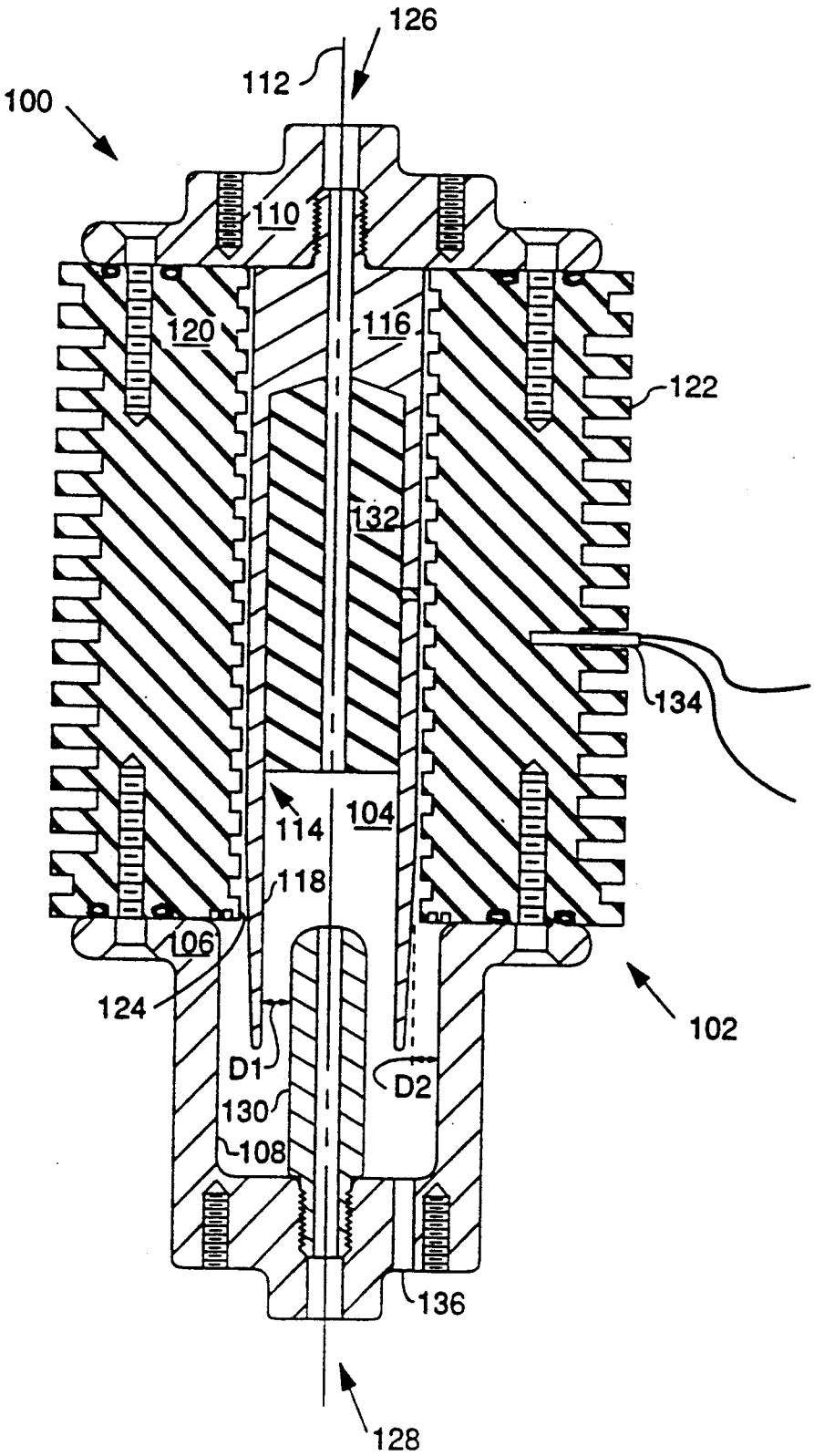
FIG. 1 is a stylized representation of a spark gap switch having first, second, and third electrodes, according to the an embodiment of the present invention.

With reference to FIG. 1, a switch 100 having a housing 102 is provided. In the preferred embodiment the housing 102 includes a body 120 and first and second end portions or endcaps 106,110. The housing 102 has a generally circular cross-section centered about an axis 112. The body 120 and first and second endcaps 106,110 form a pressurized cavity 104. The first and second endcaps 106,110 are composed of an electrically conducting material, preferably copper or a copper alloy.

The body 120 is composed of an insulating material. In the preferred embodiment, the body 120 is composed of polycarbonate. The body 120 has an exterior surface or wall 122 which is, preferably, grooved. The body 120 has an interior surface or wall 124 which is also, preferably, grooved.

In the preferred embodiment, the first endcap 106 forms a first electrode. However, the present invention is not limited to such and the first endcap and the first electrode may be separate.

The first electrode 106 has an inner surface 108. The inner surface 108 has a generally circular cross-section perpendicular to the axis 112. The inner surface 108 extends along the cavity 104 in a first direction along the axis 112, forming a hollow tube.

A second electrode 114 has first and second ends 116,118 and in the preferred embodiment is connected to the second endcap 110 at the first end 116. The second end 118 of the second electrode 114 has a generally circular cross-section perpendicular to the axis 112. The second end 118 of the second electrode 114 extends into the cavity 104 in a second direction along the axis 112. Preferably, the first and second directions are opposite. In the preferred embodiment, the second end 118 of the second electrode 114 extends at least partially into the hollow tube formed by the first electrode 102.

In one embodiment, the first and second electrodes are composed of a copper alloy. In another embodiment, the second electrode 114 includes a replaceable tip portion. The tip portion is composed of tungsten or a tungsten alloy. A suitable alloy is Elkonite, which consists of tungsten and copper.

In the preferred embodiment, the second electrode 114 is tapered. That is, the thickness of the second end portion 118 of the second electrode 114 decreases toward the end, thereby, increasing the distance between the first and second electrodes 106,114. The tapering of the second electrode 114 minimizes the firing or arcing of the switch 100 toward the end of the second electrode 114 and reducing the wear.

Figure 2:
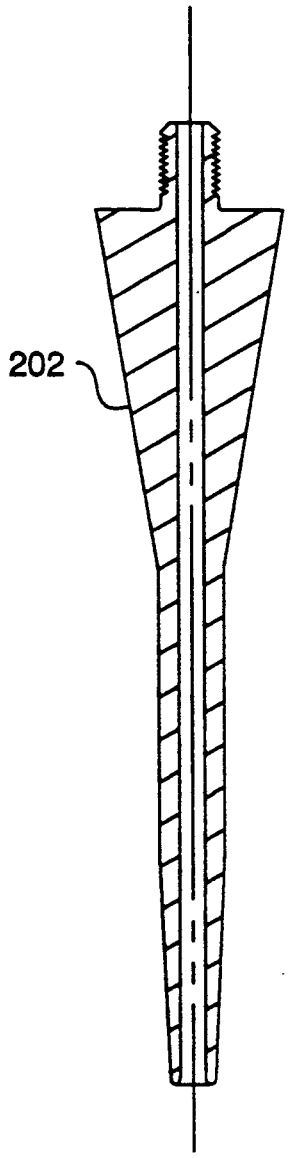
FIG. 2 is a stylized representation of an alternate embodiment of the second electrode of FIGS. 1 and 2.

The operating characteristics of the switch 100 may be modified by varying the distance between the first and second electrodes 106,114. In the preferred embodiment, this is accomplished by changing the outside diameter of the second electrode 114. With reference to FIG. 2, an alternate second electrode 202 for the switch 100 of FIG. 1 is shown. As illustrated, for a small diameter electrode, the first end portion is flanged to add mechanical stability.

In the preferred embodiment, the switch 100, includes a third electrode 130. The third electrode 130 is electrically connected to the first electrode 106. The third electrode 130 has a generally circular cross-section perpendicular to the axis 112 and extends along the axis 112 in the first direction.

In the preferred embodiment, the second electrode 114 forms a second hollow tube. The third electrode 130 extends into the second hollow tube. The distance between the second and third electrodes 114,130 (D1) is preferably less than the distance between said first and second electrodes 106,114 (D2).

The switch 100 may include an insulating insert 132 situated in the hollow tube formed by the second electrode 114. The insulating tube 132 reduces the weight, adds mechanical stability, and reduces the gas volume for faster on/off cycling response. Preferably, the insulating tube 132 is also composed of a polycarbonate and forms part of a gas outlet port 126.

A quartz window 132 permits introduction of a brief pulse of ultraviolet radiation to trigger the switch 100. The use of the quartz window 132 to trigger the switch 132 is used as an alternative triggering method or to assist at higher repetition rates to fire the switch with appropriate synchronization.

A fiber optic probe 134 senses the optical spectra emitted when the switch is firing. As shown, the probe 134, penetrate approximately halfway into the body 120 because polycarbonates allow visible light to pass.

The housing 102 is held together by a plurality of screws. In the preferred embodiment, the screws are composed of nylon. Sealing gaskets or O-rings seal the juncture between the endcaps 106,110 and the body 120.

Figure 1A:
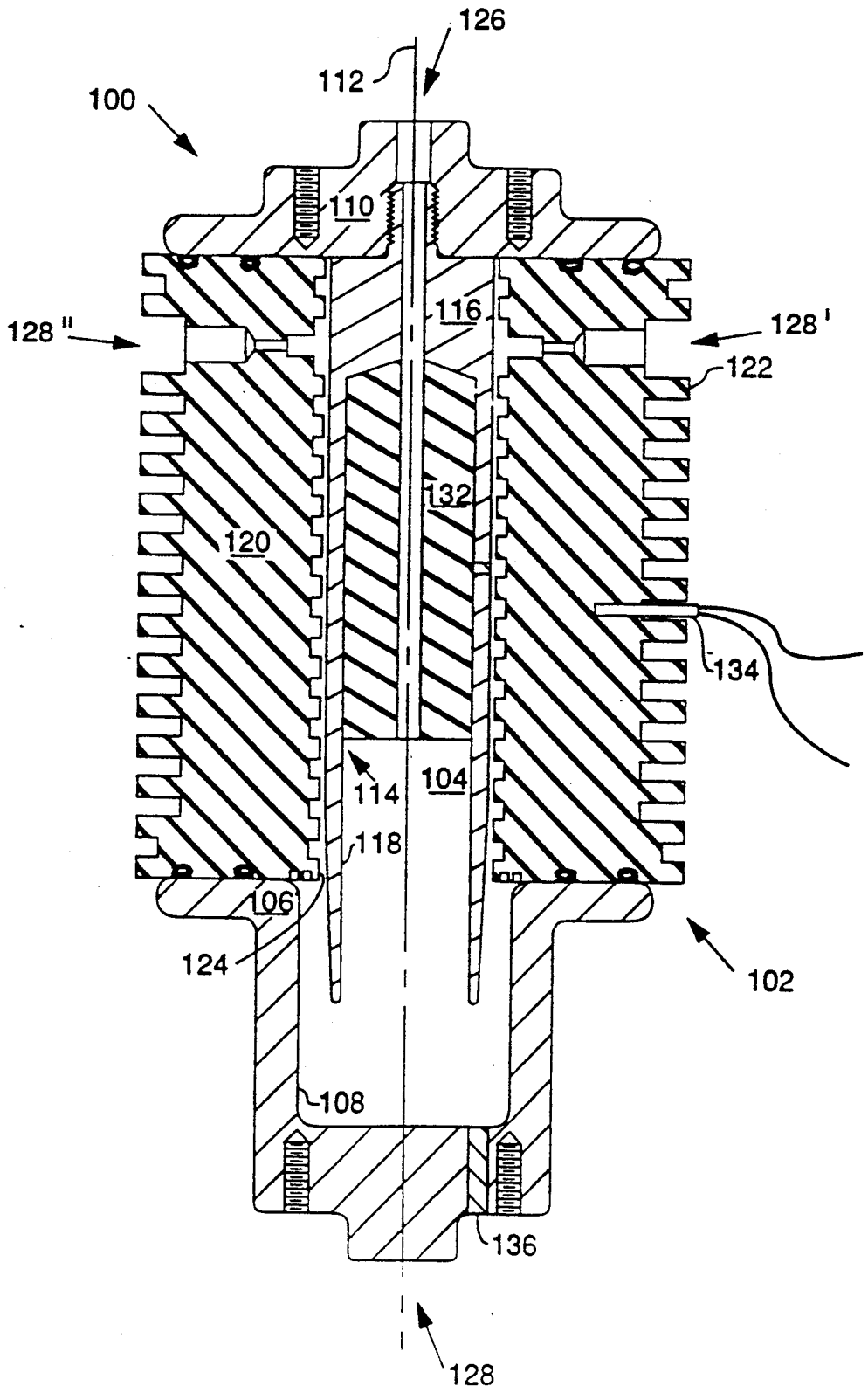
FIG. 1A is a stylized representation of a spark gap switch having first and second electrodes, according to a second embodiment of the present invention.

With reference to FIG. 1A, in an alternative embodiment, the switch 100 includes at least one gas inlet port 128',128'' in the body 120 of the housing 102 (two are shown).

Figure 1B:
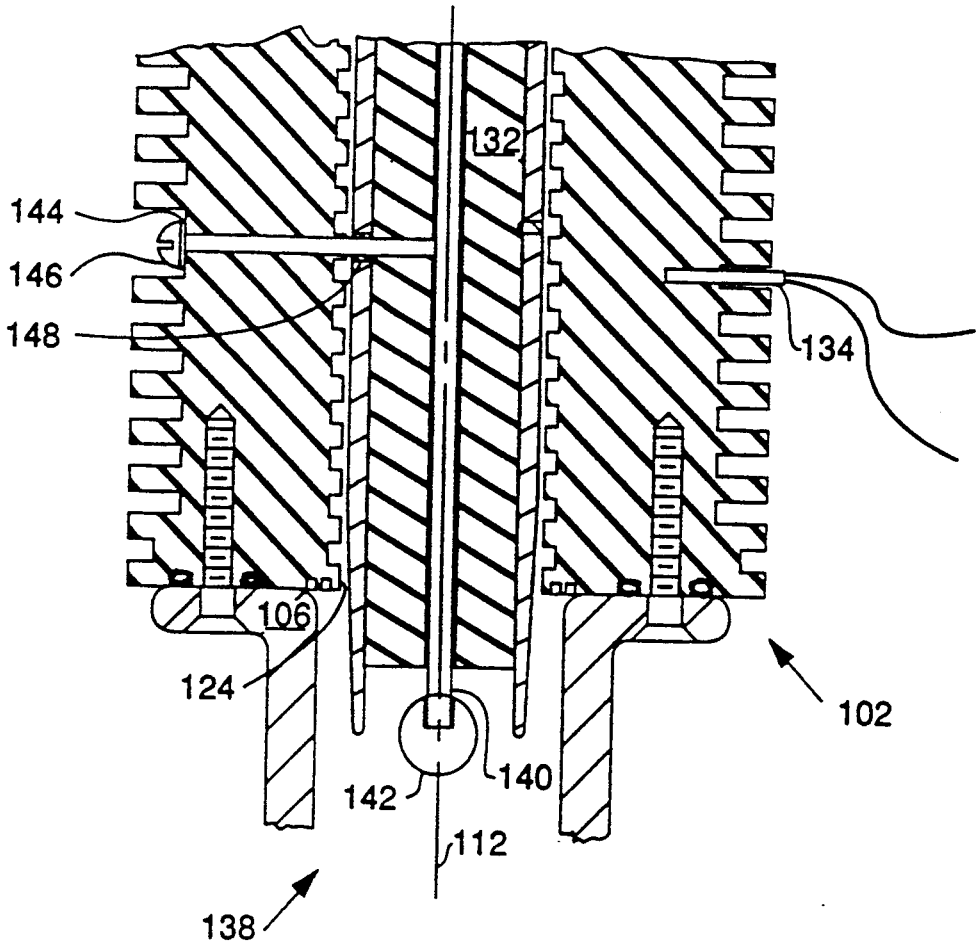
FIG. 1B is a stylized representation of the second electrode of FIGS. 1 and 2 and a trigger electrode, according to an embodiment of the present invention.

The switch 100 can be triggered by three methods, individually or in combination: ultraviolet radiation (described above), pressure (described below), and by a trigger electrode 136, as shown in FIG. 1B. In the preferred embodiment, the trigger electrode 138 includes a copper tube 140 and a brass ball 142. The copper tube 140 passes through the center of the insulator 132 and the second electrode 114. In the preferred embodiment, the trigger electrode 138 is fed a trigger pulse signal through a screw 146 and washer 144 arrangement, as shown. The trigger pulse signal creates an arc between the trigger electrode 138 and the second electrode 114 by locally extorting the electric field. The arc ionizes the gas in the cavity 104, triggering an arc between the first and second electrodes 106,114. An insulator 148 isolates the screw 146 from the second electrode 114.

Figure 3:
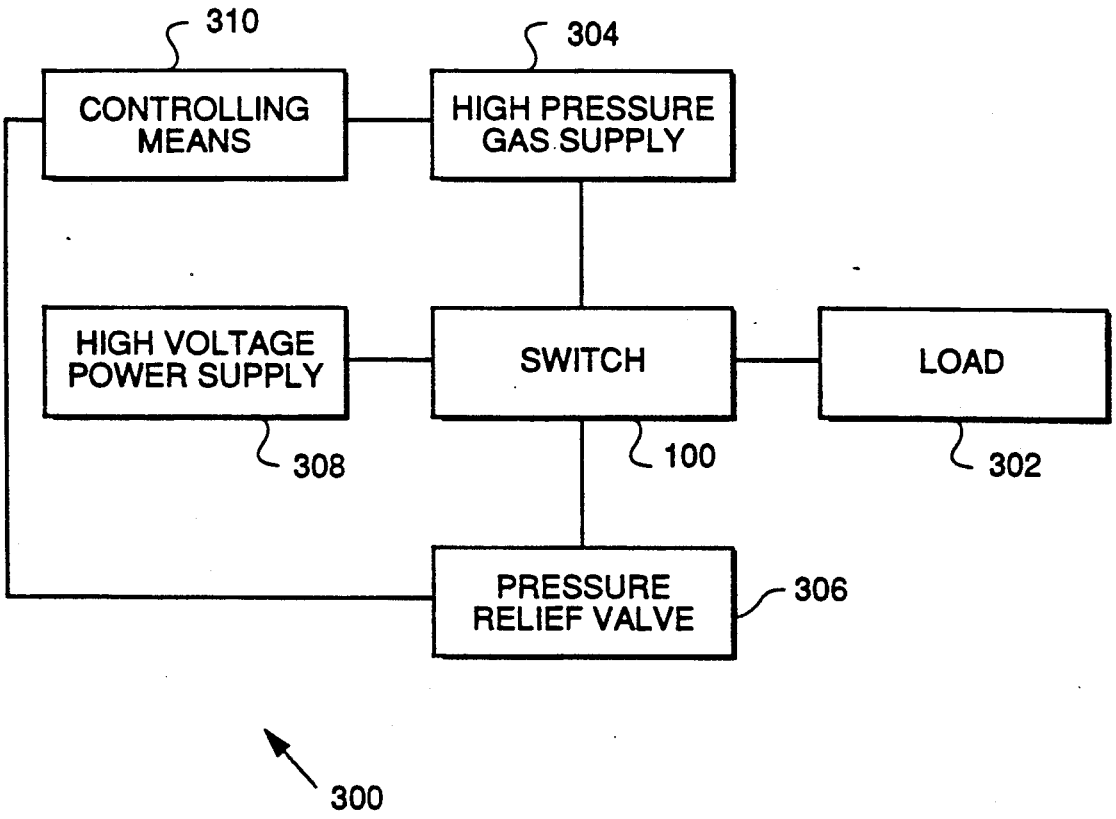
FIG. 3 is a block diagram illustrating the operation of the spark gap switch of FIG. 1.

With reference to FIG. 3, a means 300 forms a short circuit between said first and second electrodes 106,114. The means 300 controllably increases and decreases the pressure of the gas within the cavity 104 between an open value and a closed value. The gas acts as an insulator between the first and second electrodes 106,114 under said open value and as a short circuit between the first and second electrodes 106,114 under said closed value.

The switch 100 is opened and closed to supply electrical power to a load 302. In the preferred embodiment, the load 302 is connected to the first electrode 106. The second electrode 114 is electrically connected to a high voltage power supply 308.

A high pressure gas supply 304 is provided for pressurizing the cavity 104. In the preferred embodiment the cavity 104 is pressurized with sulfur hexaflouride gas, $SF_6$.

A pressure release valve 306 releases the pressure from the cavity 104.

In the preferred embodiment, the cavity 104 is pressurized and unpressurized by actuation of the high pressure gas supply and pressure release valve 304,306 through a gas inlet port 128 and a gas outlet port 126, respectively, by a controlling means 310.

Industrial Applicability

With reference to the drawings and in operation, the present invention is adapted to provide a highly reliable switch 100 that is durable, compact, low cost, and more easily serviced.

As described above, the switch 100 is generally operated by controllably increasing and decreasing the pressure within the switch 100. This has two advantages. First, it automatically cycles the gas within the cavity 104, thereby lowering the temperature. This aids in keeping the electrodes cool. Second, by changing the gas within the switch 100 between firings, contaminants are removed from the cavity 104. Furthermore, when the gas is released, the pressure gradient created between the the first and second electrodes 106,114 favors the formation of an arc discharge away from the end of the second electrode 114. This produces a lower and more uniform current density.

The controlling means 310 closes the switch 100 by opening the pressure relief valve 306 and releasing the SF6 gas. Typically, the switch 100 is pressurized to approximately 6 atmospheres. However, pressures up to 12 atmospheres may be used.

When the pressure reaches a certain value (depending upon the switch characteristics) the switch 100 will fire. When the switch 100 fires, an arc is formed between the first and second electrodes 106,114. The electrodes 106,114 are designed to provide greater surface area for current to flow between the first and second electrodes. This effectively decreases the current density, the ohmic resistance, and the inductance of the switch 100.

The third electrode 130 further reduces the resistance and inductance of the switch 100. In operation, within nanoseconds of the switch's firing an arc will form between the second and third electrodes 114,130. This second arc occurs after the first arc because the gap between the second and third electrodes, 114,130 (D1), is slightly larger than the gap between the first and second electrodes 106,114 (D2). Furthermore, the first arc produces ionizing ultraviolet radiation which expedites the triggering of the second arc.

The grooves in the inner and outer surfaces 122,124 of the body 120 aid in increasing the voltage insulation between the endcaps and electrodes 106,110,114,130. The tapering at the end of the second electrode 114 helps reduce the wear at the tip, switching on speed, further reduces the inductance, and increases the lifespan of the electrode 114.

Furthermore, the rugged design and ease of dismantling and assembly make the switch very serviceable in the field.

The switch has been tested between 15-300 kV (in an external air environment). However, by scaling the design up, the switch should be able to handle voltages up into the megavolt range. The operating characteristic of the switch 100 can be modified by changing the diameters of the first and/or second electrode 106,114 or by scaling the dimensions of the entire switch 100.

Other aspects, object, and features of the present invention can be obtained from a study of the drawings, the disclosure, and the appended claims.

We claim:

1. A switch, comprising:

a housing forming a cavity;

a first electrode having an inner surface, said inner surface having a generally circular cross-section perpendicular to an axis and extending along said cavity in a first direction along said axis, forming a hollow tube; and, a second electrode having first and second ends, said first end being connected to said housing, said second end of said second electrode having a generally circular cross-section substantially perpendicular to said axis and extending into said cavity in a second direction along said axis, wherein said second end of said second electrode extends at least partially into said hollow tube formed by said first electrode.

2. A switch, as set forth in claim 1, where said housing includes a body and first and second end portions.

3. A switch, as set forth in claim 1, wherein said housing includes a body and an end portion, wherein said body, said end portion, and said first electrode form said cavity.

4. A switch, as set forth in claim 1, wherein said cavity is pressurized.

5. A switch, as set forth in claim 1, includes means for forming a short circuit between said first and second electrodes.

6. A switch, as set forth in claim 1, wherein said first and second directions are opposite.

7. A switch, as set forth in claim 1, wherein housing includes a body composed of an insulating material.

8. A switch, as set forth in claim 1, wherein housing includes a body composed of a polycarbonate.

9. A switch, as set forth in claim 7, wherein said body has a generally circular cross-section perpendicular to and centered about said axis.

10. A switch, as set forth in claim 7, wherein said body has an exterior wall, said exterior wall being grooved.

11. A switch, as set forth in claim 7, wherein said body has an interior wall, said interior wall being grooved.

12. A switch, as set forth in claim 1, wherein said cavity is pressurized with sulfur hexaflouride gas.

13. A switch, as set forth in claim 1, including means for controllably increasing and decreasing the pressure of said gas within said cavity between an open value and a closed value, wherein said gas acts as an insulator between said first and second electrodes under said open value and as a short circuit between said first and second electrodes under said closed value.

14. A switch, as set forth in claim 13, including a gas inlet port and a gas outlet port.

15. A switch, as set forth in claim 14, wherein said gas outlet port is formed by said housing.

16. A switch, as set forth in claim 1, including a quartz window and wherein said switch is triggered by ultraviolet radiation.

17. A switch, as set forth in claim 1, including a trigger electrode and wherein said switch is triggered by a trigger pulse signal applied to said trigger electrode.

18. A switch, as set forth in claim 1, including a third electrode.

19. A switch, as set forth in claim 18, wherein said third electrode is electrically connected to said first electrode.

20. A switch, as set forth in claim 18, wherein said third electrode has a generally circular cross-section perpendicular to said axis and extending along said axis in said first direction.

21. A switch, as set forth in claim 20, wherein said second electrode forms a second hollow tube and said third electrode extends into said second hollow tube.

22. A switch, as set forth in claim 21, wherein the distance between said second and third electrodes is less than the distance between said first and second electrodes.

23. A switch, comprising:

a housing having a body, a first endcap and a second endcap forming a pressurized cavity, said housing having a generally circular cross-section centered about an axis;

said first endcap having an inner surface and extending into said cavity in a first direction along said axis, said inner surface having a generally circular cross-section perpendicular to said axis, forming a hollow tube, said first endcap being composed of a conducting material, whereby said first end acts as a first electrode;

a second electrode having first and second ends and being connected to said second endcap, said second end of said second electrode having a generally circular shape and extending into said cavity in a second direction along said axis, said first and second directions being opposite, wherein the diameter of said inner surface of said first endcap is greater than the diameter of said second end of said second electrode and said second end of said second electrode extends at least partially into said hollow tube formed by said first electrode; and, means for creating a short circuit condition between said first and second electrodes.

24. A switch, as set forth in claim 10, including a third electrode electrically connected to said first electrode, said third electrode having a generally circular cross-section perpendicular to said axis and extending along said axis in said first direction, wherein said second electrode forms a second hollow tube and said third electrode extends into said second hollow tube and the distance between said second and third electrode is less than the distance between said first and second electrodes.

* * * * *